US006402127B1

(12) United States Patent
Meglino et al.

(10) Patent No.: US 6,402,127 B1
(45) Date of Patent: Jun. 11, 2002

(54) FENCE SLATS WITH LOCKING PORTIONS

(75) Inventors: Don A. Meglino; James V. Meglino, both of Hicksville, NY (US)

(73) Assignee: Bunzl Extrusion, Inc., Richmond, VA (US)

( * ) Notice: Subject to any disclaimer, the term of this patent is extended or adjusted under 35 U.S.C. 154(b) by 0 days.

(21) Appl. No.: 09/664,252

(22) Filed: Sep. 18, 2000

(51) Int. Cl.[7] ..... E04H 17/14

(52) U.S. Cl. ..... 265/65; 265/1; 265/32; 265/50

(58) Field of Search ..... 256/1, 34, 32, 256/50, 51, 65

(56) References Cited

U.S. PATENT DOCUMENTS

| | | | | | |
|---|---|---|---|---|---|
| 5,184,801 | A | * | 2/1993 | Finkelstein | 256/34 |
| 5,584,468 | A | * | 12/1996 | Meglino et al. | 256/34 |
| 5,687,957 | A | * | 11/1997 | Finkelstein | 256/34 |
| 5,799,929 | A | * | 9/1998 | Meglino et al. | 256/34 |
| 6,068,243 | A | * | 5/2000 | Hoggan | 256/34 |

* cited by examiner

*Primary Examiner*—Lynne H. Browne
*Assistant Examiner*—Aaron Dunwoody
(74) *Attorney, Agent, or Firm*—Jacobson Holman, PLLC

(57) ABSTRACT

Fence slats having a body portion defined by a first tubular section, an intermediate portion and a second tubular section integrally formed with the intermediate portion. At least one and preferably a plurality of outwardly extending stops are formed in the intermediate portion.

24 Claims, 8 Drawing Sheets

FENCE SLATS WITH LOCKING PORTIONS

The present invention is directed to privacy fence inserts for chain link fences and, more particularly, to fence slats comprising an elongated body preferably comprising at least one substantially tubular portion, a non-tubular portion and at least one stop for inhibiting undesired movement of the slat after insertion in a fence.

BACKGROUND OF THE INVENTION

Chain link fences have been widely used for many years to satisfy fencing requirements. While they provide acceptable strength and durability over many years, they do not provide privacy or serve as a windbreak due to their apertured construction. Various inserts, typically referred to as "slats", have been suggested and manufactured for increasing the privacy of a chain link fence, as well as serving as a windbreak. Many early arrangements were designed to be directly connected to the link of the fence and required clamping or bending of a metal slat onto a link of the fence.

One of the inventors of the present invention overcame a problem with slats migrating upwardly and downwardly due to wind or other environmental forces which creates an unfinished uneven appearance, by providing a slat retaining means which extended through a slot in the slats and which is further described in U.S. Pat. No. 4,512,556 to Meglino, issued on Apr. 23, 1985. Other attempts to maintain the slats properly disposed in the chain link fence include a separate bottom member which attaches to the bottom of the slats. A drawback with these slats is that they require a cross-member which increases the overall cost of the fence and are more time consuming to install.

Other attempts to maintain the slats properly within a chain link fence include U.S. Pat. No. 5,458,319 to Mackay which discloses a retainer device which is inserted in a groove in a slat and attaches to a link of a fence, and U.S. Pat. No. 5,275,380 to Barsby which discloses a corrugated slat having a raised rounded retaining tab having a groove which readily engages a link of a fence in a snap-fit manner. Drawbacks with the slats disclosed in Mackay and Barsby is that the slat disclosed in Mackay requires a separate element which increases the slats cost and is time consuming to install, and the slat disclosed in Barsby while easily inserted due to its design may also be easily removed from the fence.

The present inventors have disclosed other possible solutions to this problem in U.S. Pat. No. 5,799,929 wherein fence inserts are disclosed comprising outwardly extending stops wherein one of the wires of a chain link fence is positionable in a passageway defined by the outwardly extending stops. The various embodiments disclosed in the present inventor's earlier U.S. Pat. No. 5,799,929 can be readily inserted and provide significant resistance to removal, however, they pose manufacturing obstacles. For example, in order to integrally form the stops in a slat of the type shown in FIG. 3 of applicant's earlier patent, a portion of a stamp needed to be inserted into a tubular portion of the slat following extrusion but before the slat had cooled entirely. The proper alignment and insertion of the stamp into a hot, non-hardened fence slat can pose manufacturing difficulties. Therefore, it is particularly desirable to provide a slat which has the advantages of an easy to insert locking feature, yet which is easier to manufacture.

SUMMARY OF THE INVENTION

Various embodiments comprise a body portion and at least one, but preferably a plurality of substantially tubular portions and an intermediate non-tubular portion which can be slightly curved, flat, segmented, and/or combinations thereof. The non-tubular intermediate portions are readily adaptable for stamping before the slat has hardened following extrusion since two portions of a stamp can be readily applied to opposing surfaces of the non-tubular portion without the need for prior insertion into a tubular section.

Preferred embodiments of the present invention comprise fence slats having a body portion defined by a first tubular section, an intermediate portion and a second tubular section integrally formed with the intermediate portion. At least one and preferably a plurality of outwardly extending stops are formed in the intermediate portion and are spaced from each other to define a passageway therebetween. When the slat is received in a channel of a chain link fence, a portion of a link is positionable in the passageway to inhibit removal or undesired movement of the slat due to wind, vibration, vandalism, etc.

In one preferred embodiment, at least one of the stops comprises a tapered surface which facilitate insertion of the slat into a channel of a chain link fence. Other stops of this and other embodiments of the present invention are configured as a pair of raised circular tabs.

According to still other embodiments of the present invention, the intermediate portion between two substantially tubular portions are disposed proximate, both the front and rear surfaces of the slat. According to this embodiment of the present invention, the stops are preferably disposed on both the front and rear of the slat and, therefore, provide a slat which is effectively reversible.

DETAILED DESCRIPTION

Figure 1:
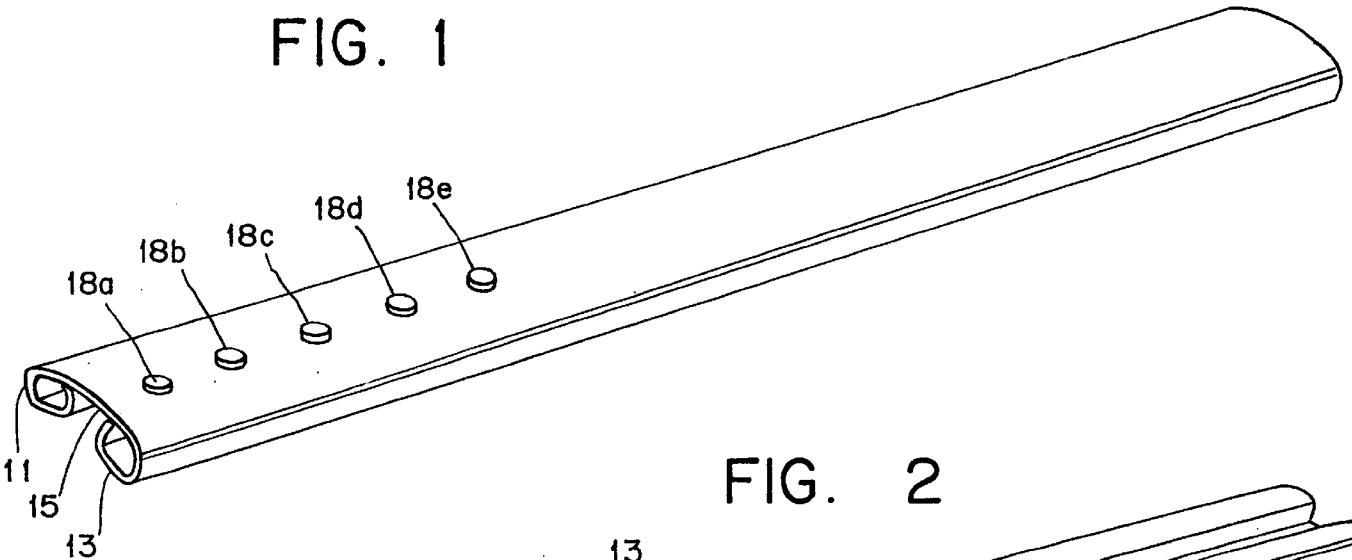
FIG. 1 is a top perspective view of one embodiment of the present invention.
Figure 2:
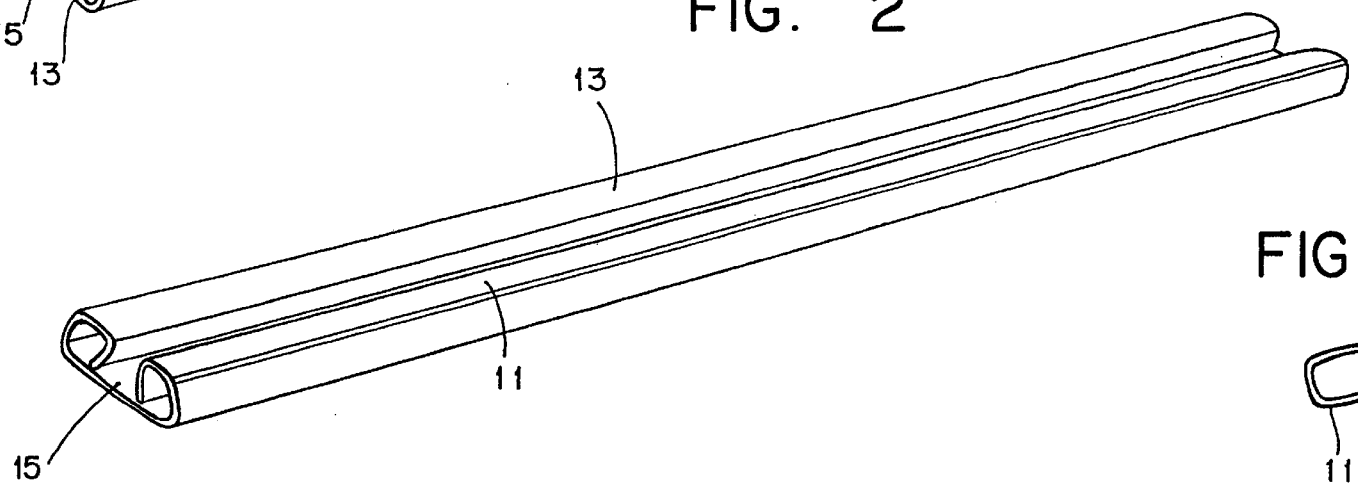
FIG. 2 is a bottom perspective view of the embodiment shown in FIG. 1.
Figure 3:
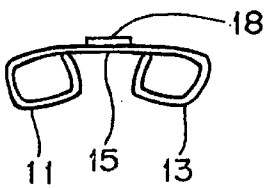
FIG. 3 is an end view of the embodiment shown in FIG. 1.
Figure 6:
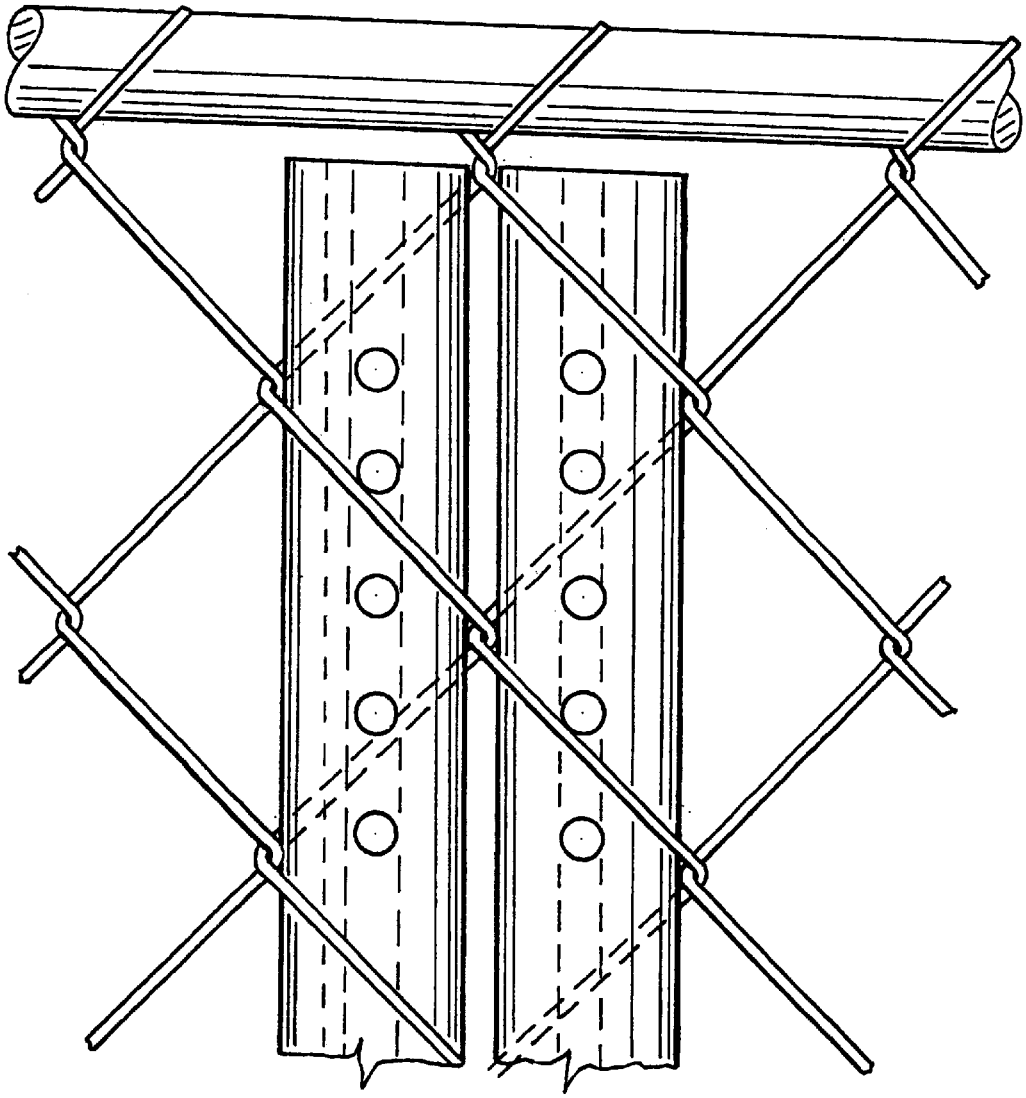
FIG. 6 illustrates the slat shown in FIG. 1 positioned in a chain link fence.
Figure 7:
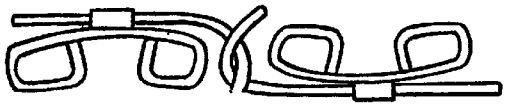
FIG. 7 is a bottom view of an alternative arrangement of the slats shown in FIG. 6.

One embodiment of the present invention is illustrated in FIGS. 1–3. This illustrated embodiment comprises an elongated slat comprising a left tubular section 11, a right tubular section 13 and an intermediate portion 15. As best shown in the bottom view of FIG. 2, the tubular portions of this embodiment extend the entire length of the slat. Intermediate portion 15 is formed with a plurality of protrusions 18*a*–18*e*. The tubular portions of this illustrated slat are designed to give the slat sufficient depth so that when the slat is inserted into a channel of chain link fence, protrusions 18 will be urged beyond the interior edges of the wires forming the fence. In this manner, after insertion, further vertical movement of the slat will be inhibited. While it is contemplated that the slats will be inserted with the protrusions facing a rear side of a channel, it is also within the scope of the present invention to insert the slats with the protrusions extending forwardly. FIG. 6 illustrates one arrangement of the slats of the type shown in FIGS. 1–3 positioned in a fence.

Figure 4:
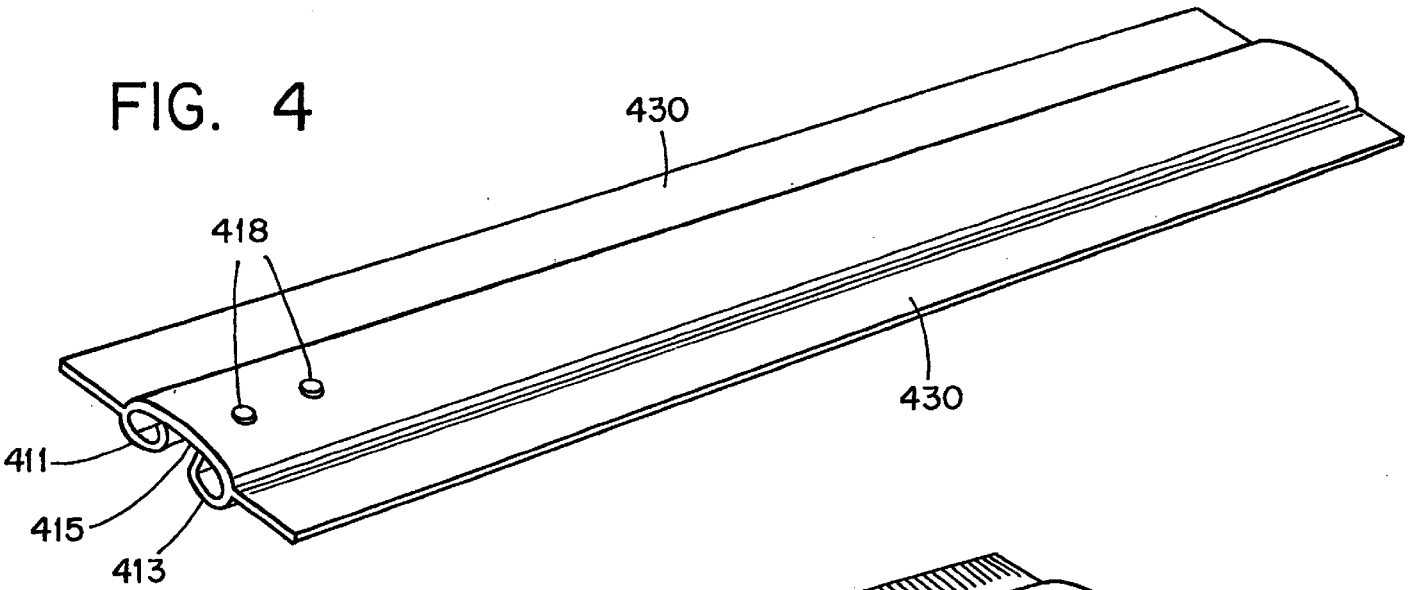
FIG. 4 is a top perspective view of a winged slat of the present invention.
Figure 5:
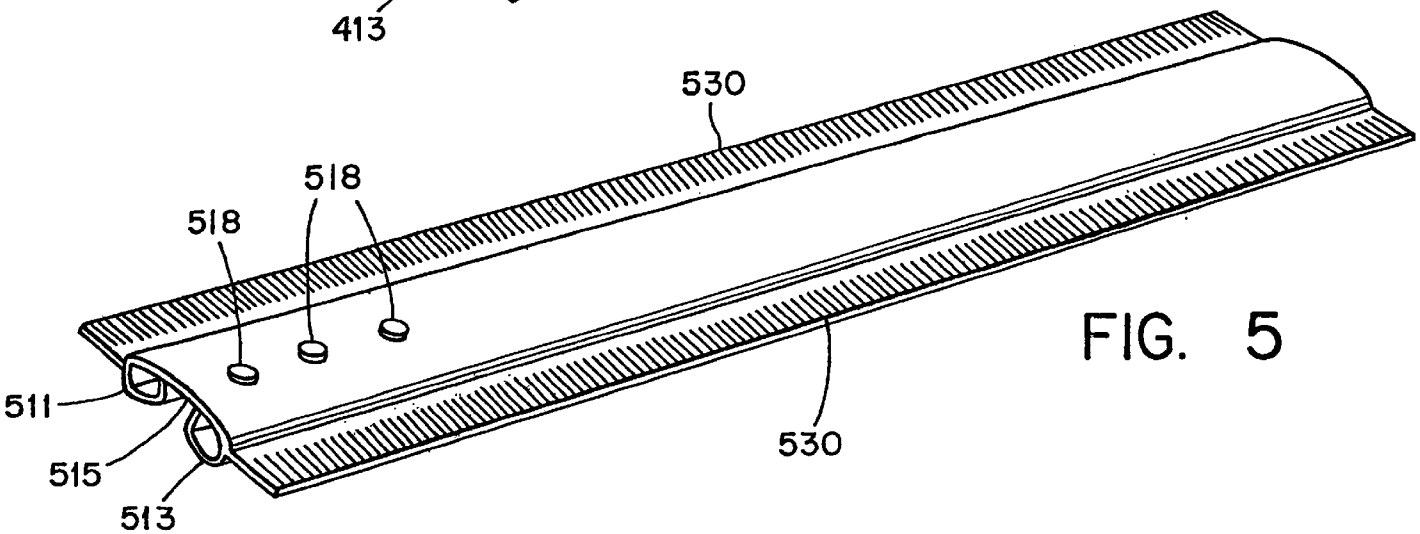
FIG. 5 is a top perspective view of an alternative winged slat of the present invention with slit wings.

FIGS. 4 and 5 illustrate alternative winged embodiments of the present invention wherein slats of the general type illustrated in FIG. 1 are provided with continuous wing portions 430 and slit winged portions 530, respectively. In other respects, these illustrated embodiments are the same in that the embodiment shown in FIG. 4 comprises a left tubular portion 411, an intermediate portion 415, a right tubular portion 413, and protrusions 418. This illustrated embodiment only comprises two protrusions.

Similarly FIG. 5 comprises a left tubular portion 511 and intermediate portion 515 and a right tubular portion 513, and protrusions 518. This illustrated embodiment only comprises three protrusions.

According to these and all other embodiments of the present invention, different numbers of protrusions can be provided and the protrusions can have different shapes. Furthermore, one or more portions of the fence slat can be formed of different materials. For example, the slat can have an inner portion formed of one material while other portions can comprise different materials. Alternatively, winged portions and/or an outer encapsulating layer can be formed of a polymeric material which is more or less resilient than the inner portion and/or which comprises different polymers or a different polymeric blend.

For example it may be desirable to co-extrude the slats using a relatively rigid material for one or more portions and a more resilient for one or more other portions. The slats of the present invention and their respective protrusions, stops and winged portions are most preferably formed as an integral unit and are preferably formed from a thermoplastic, polymeric material, e.g., polyethylene, polypropolyne or combinations thereof, which may be aesthetically colored to provide a pleasing appearance. It is also within the scope of the present invention to form one or more of the tubular sections from a different polymer than the intermediate portion and/or the winged portions. For example, if the intermediate portion is formed of a more resilient material, the slat can be provided with greater resiliency for insertion into a fence. Alternatively, one or more of the ends, intermediate portions, or wings can be formed of materials having greater resiliency.

Figure 8A:
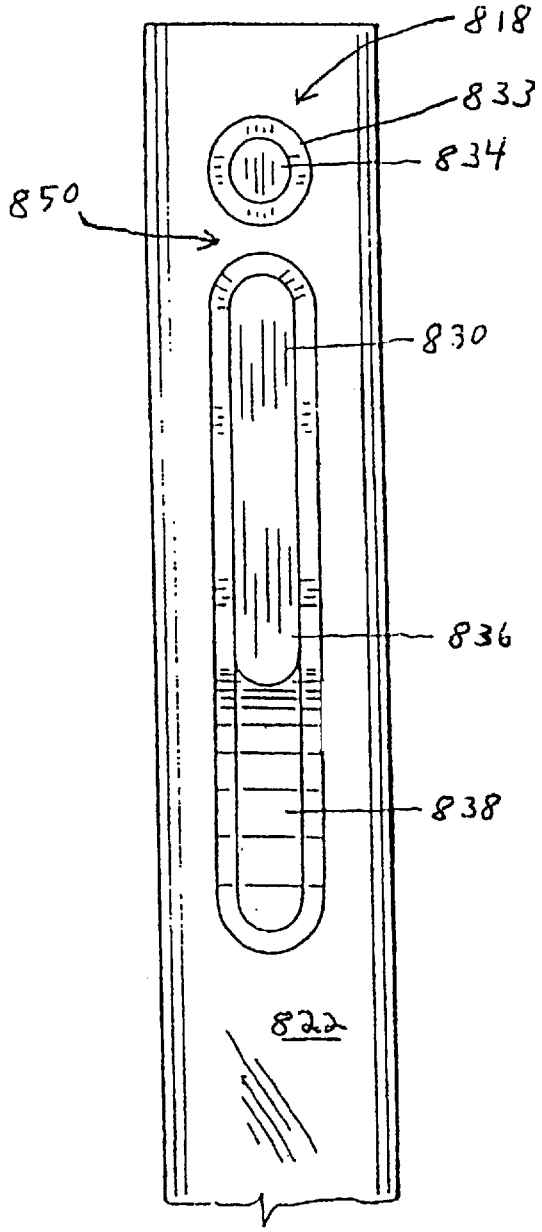
FIGS. 8A and 8B are top and side views respectively, illustrating a tapered stop of one embodiment of the present invention.
Figure 8B:
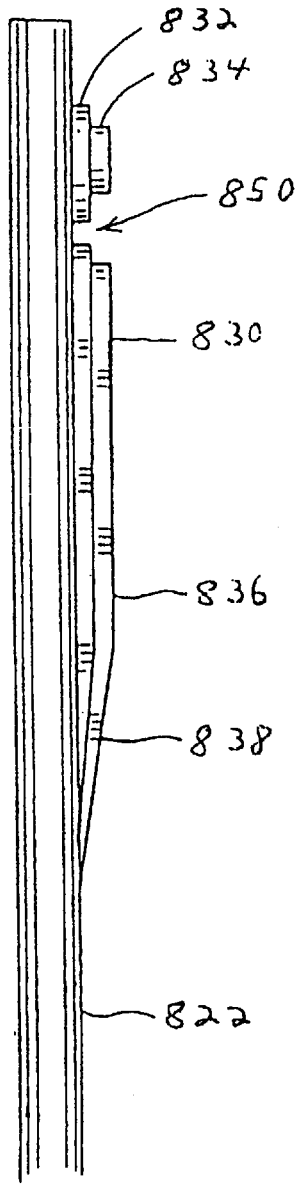

In the embodiment illustrated in FIGS. 8A and 8B, stop 818 comprises a base portion 832 upon which is disposed an outer portion 834. As illustrated, stop 830 is elongated and disposed longitudinally along surface 822 of the intermediate portion of this slat. This stop 830 also comprises a generally flat surface portion 836 and a tapered surface portion 838 to readily allow this slat to be inserted into a channel of a chain link fence. From the present invention, those skilled in the art will appreciate that the taper of surface 838 will facilitate the downward insertion of the slat into a fence channel. The stop 818 is advantageously spaced from stop 830. Passageway 850 preferably has a depth sufficient to receive the full diameter of a wire from a chain link fence. The entire fence slat is preferably dimensioned to extend between the knuckles of a chain link fence when inserted therein and is preferably hollow for economic manufacture by extrusion.

Figure 9A:
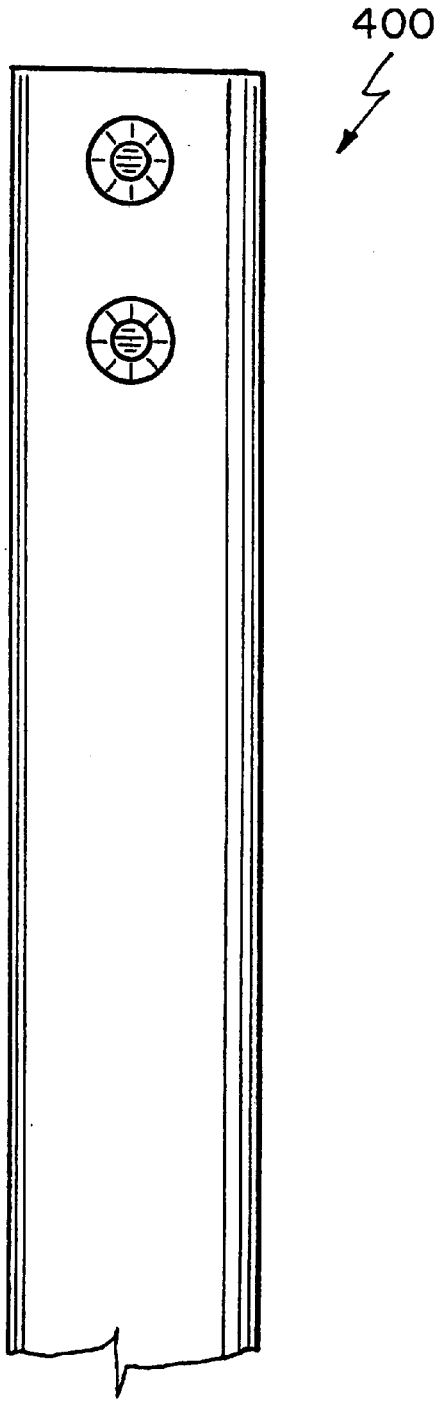
FIGS. 9A and 9B are top and side views showing generally circular stops of an alternative embodiment.
Figure 9B:
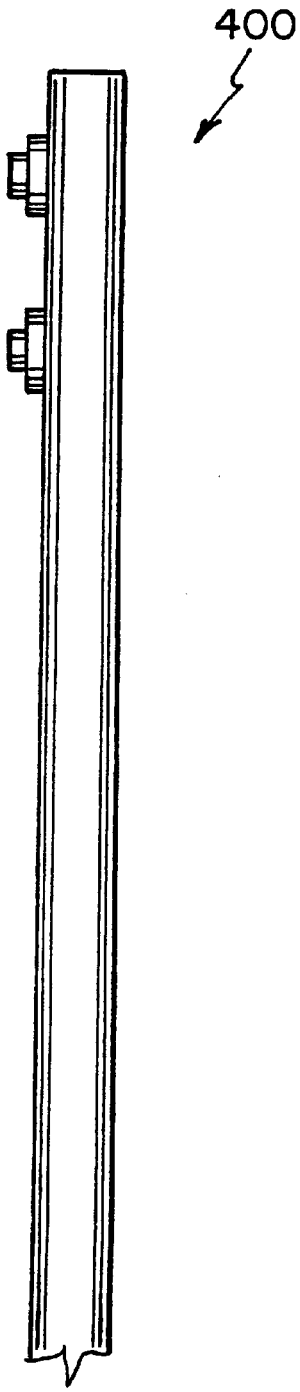

FIGS. 9A and 9B illustrate an alternative embodiment of the present invention in which a fence slat 900 comprises a first elongated tubular portion 911, an intermediate portion 915, a second tubular portion 913, and a pair of spaced, generally circular raised stops 930 and 940 positioned on surface 920 of the intermediate portion 915. The stops 930 and 940 define a passageway 950 for receiving a wire of a chain link fence in order to retain the slat in a channel of the chain link fence once inserted.

Figure 10B:
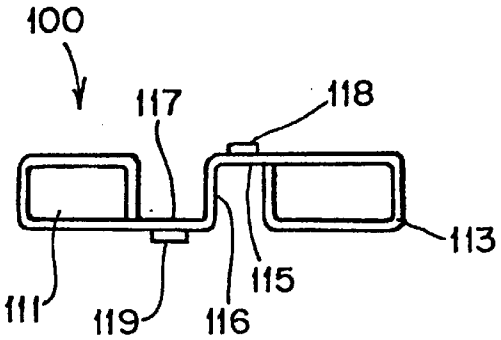
FIGS. 10A and 10B are perspective and end views, respectively, of an alternative embodiment of the present invention.
Figure 10A:
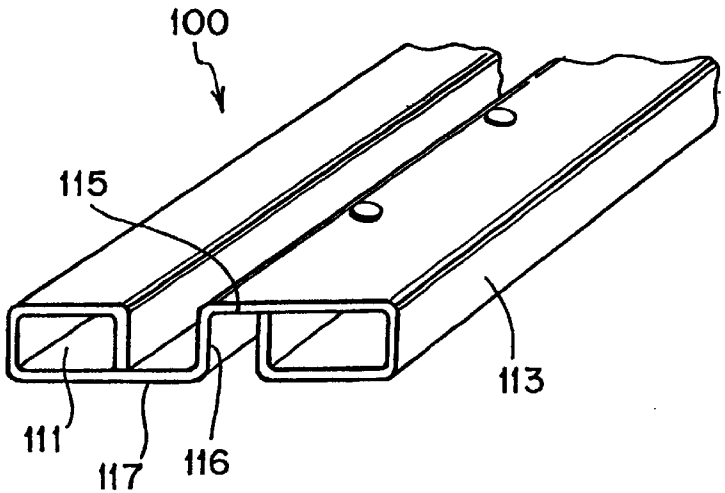

The intermediate and/or non-tubular portions are not necessarily flat or substantially flat. As shown in the embodiment of FIGS. 10A and 10B, a slat 100 comprises a first tubular portion 111 and a second tubular portion 113. For purposes of reference, the top portion of the slat shown in this illustration will be referred to as the forward side of the slat while the lower portion in the illustration will be referred to as the rear side of the slat. The intermediate portion is formed comprising three segments with a forward segment 115 adjacent tubular portion 113, a rearward segment 117 adjacent tubular portion 111, and a connecting segment 116. Additionally, a plurality of protrusions 118 extend forwardly from the forward surface of intermediate section 115 and a plurality of protrusions 119, best shown in FIG. 10B, extend rearwardly from intermediate portion 117. FIG. 10B is an end view of this embodiment of the present invention. Providing an intermediate member having both forwardly and rearwardly facing surfaces facilitates the placement of protrusions or stops on both the front and back of the slat.

Figure 11:
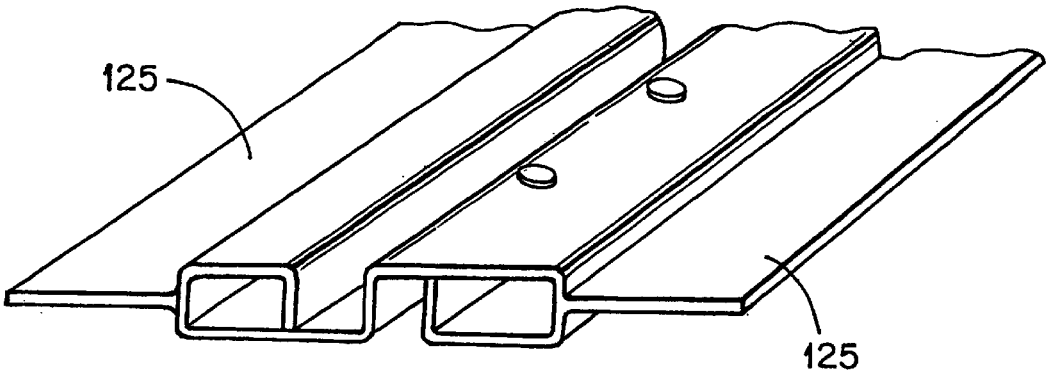
FIG. 11 illustrates a winged embodiment of the present invention with a segmented intermediate portion.

FIG. 11 illustrates a still further embodiment of the present invention generally in the form of the embodiment of FIG. 10 but further comprising winged portions 125.

While it is most desirable and easier to manufacture fence inserts wherein the protrusions extend only from generally flat surfaces, in accordance with other embodiments of the present invention, slats are provided with protrusions extending from one or more tubular portions of a slat. According to these embodiments of the present invention, protrusions can extend from a single tubular portion, a plurality of tubular portions, or at least one tubular portion and at least one non-tubular portion.

Figure 13:
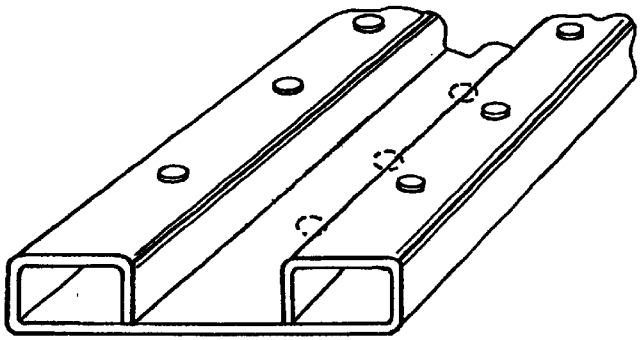
FIG. 13 illustrates an embodiment of the present invention with stops on both the intermediate portion and the tubular portion.
Figure 12:
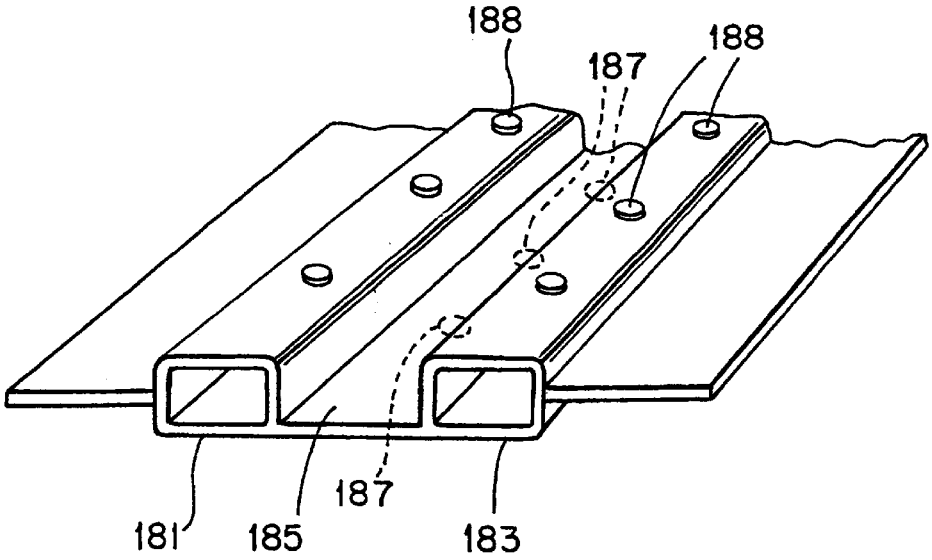
FIG. 12 illustrates a winged embodiment of the present invention with a substantially flat intermediate portion.

With reference to FIG. 12, a winged slat of another embodiment of the present invention comprises two tubular sections 181 and 183 each of which comprise a plurality of forwardly facing projections 188 and an intermediate portion 185 which connects the tubular sections and comprises a plurality of rearwardly facing protrusions 187 (shown in phantom). A similar alternative embodiment is shown in FIG. 13 without the winged portions.

Figure 14:
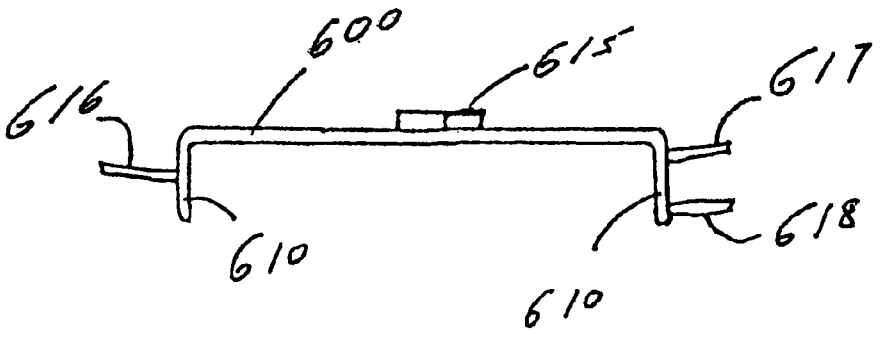
FIG. 14 illustrates an alternative embodiment of the present invention.

FIG. 14 illustrates an end view of an alternative embodiment of the present invention wherein the end portions are not tubular. According to this embodiment of the present invention, the end portions 610 extend from body portion 600 at an angle wherein the end portions 610 are substantially perpendicular to the body portion 600. End portion 610 can be of any predetermined length and are preferably dimensioned to span from the front of a channel to the back of the channel formed by the wires of a chain link fence. Those skilled in the art will appreciate that if end portions 610 do not provide sufficient depth for this fence insert, then stop 615 would not be pushed into engagement with the wires of the fence. This illustrated embodiment also comprises a first wing member 616 on one end portion 610 and two wing portions 617 and 618 on the opposite end portion 610.

Figure 15:
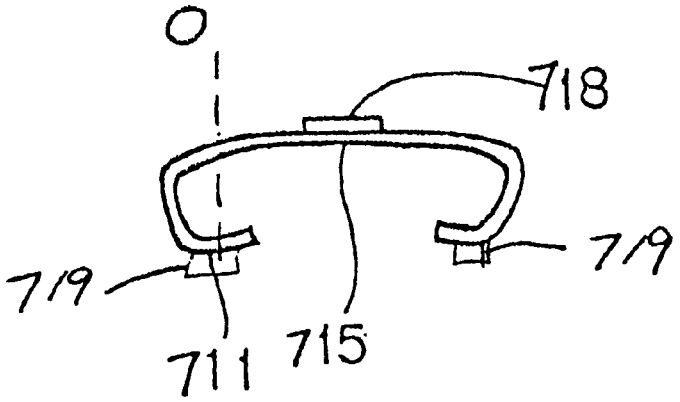
FIG. 15 illustrates a still further embodiment of the present invention.

A further embodiment of the present invention is illustrated in FIG. 15 wherein a fence insert comprises a body portion 715 and a stop 718. The ends of this fence insert are formed as general curves which extend away from body portion 715 for a depth sufficient to span a channel of a fence. Unlike the fence inserts illustrated in FIGS. 1 to 13, this illustrated embodiment also comprises end portions which are not tubular but which are generally curved such that there is some overlap between the end portion 711 and the body portion 715 as indicated by dashed line 0. Additionally, each end portion also comprises a stop 719.

While the preferred illustrated embodiments of the present invention are integrally formed during a single extrusion and stamping process, it is also within the scope of the present invention to form fence slats from a plurality of separately formed elements.

What is claimed is:

1. A fence slat receivable in a channel formed by inter-woven wires of a chain link fence, the interior edges of the wires of the chain link fence defining the channel as having a depth from front to back of the chain link fence, said fence slat comprising an elongated sheet defining walls of said fence slat of substantially constant thickness including an elongated intermediate portion extending substantially along the length of the slat and first and second elongated side portions integrally connected by said intermediate portion and extending away from said intermediate position to define free longitudinal edges extending substantially along the length of said fence slat, said side portions defining a depth for said fence slat, and said fence slat depth approximating the depth of the channel into which said fence slat is to be inserted, each of said side portions defining an elongated, substantially tubular portion and said intermediate portion being non-tubular.

2. A fence slat for a chain link fence according to claim 1 wherein said tubular portions and said non-tubular portion comprise a thermoplastic.

3. A fence slat for a chain link fence according to claim 1 wherein each of said elongated substantially tubular portions comprises a substantially rearwardly facing surface and said non-tubular portion extends from a position proximate said rearwardly facing surface of said first tubular portion to a position proximate said rearwardly facing surface of said second tubular portion.

4. A fence slat for a chain link fence according to claim 3 wherein said raised projection extend rearwardly from said non-tubular portion.

5. A fence slat for a chain link fence according to claim 3 wherein said fence slat comprises a plurality of said raised projections.

6. A fence slat for a chain link fence according to claim 5 wherein said raised projections extend rearwardly from said non-tubular portion.

7. A fence slat for a chain link fence according to claim 1 wherein said fence slat comprises a top and a bottom and at least one raised projection comprising a tapered surface extending downwardly to facilitate insertion of said privacy insert downwardly into a chain link fence and an upwardly facing abutment surface to hinder upward removal of the privacy insert following insertion in a chain link fence.

8. A fence slat for a chain ink fence according to claim 1 further comprising at least one wing member extending laterally from one of said tubular portions.

9. A fence slat for a chain link fence according to claim 8 comprising at least one wing member extending laterally from both of said tubular portions.

10. A fence slat for a chain link fence according to claim 8 wherein said wing member is formed of a material different from said tubular portions.

11. A fence slat for a chain link fence according to claim 8 wherein said wing member comprises slits.

12. A fence slat for a chain link fence according to claim 1 comprising at least one raised projection extending from at least one of said tubular portions.

13. A fence slat for a chain link fence according to claim 12 comprising at least one raised projection extending from both of said tubular portions.

14. A fence slat for a chain link fence according to claim 1 comprising a front and a back and at least one raised projection extending from each of said front and said back.

15. A fence slat for a chain link fence according to claim 1 wherein said non-tubular portion is substantially flat.

16. A fence slat for a chain link fence according to claim 1 wherein said non-tubular portion is curved.

17. A fence slat for a chain link fence according to claim 1 wherein said non-tubular portion is segmented.

18. A fence slat for a chain link fence according to claim 1 wherein said non-tubular portion is positioned between the forward side of said slat and the rearward side of said slat.

19. A fence slat according to claim 1, further including at least one raised projection extending from said intermediate portion, the depth of each of said side portions being sufficient to urge said raised projection beyond the interior edges of the wires forming the channel of the chain link fence.

20. A fence slat receivable in a channel formed by inter-woven wires of a chain link fence said fence slat comprising:

a first elongated, substantially tubular portion;

a second elongated, substantially tubular portion;

a non-tubular portion connecting said first and second elongated, substantially tubular portions, said non-tubular portion comprising a first surface proximate the forward side of said slat and a second surface proximate the rearward side of said slat.

21. A fence slat for a chain link fence according to claim 20 further comprising at least one protrusion extending from at least one of said surface or said second surface.

22. A fence slat for a chain link fence according to claim 20 further comprising at least one protrusion extending from each of said first surface and said second surface.

23. A fence slat for a chain link fence according to claim 20 further comprising a plurality of protrusions extending from at least one of said first surface or said second surface.

24. A fence slat for a chain link fence according to claim 20 further comprising a plurality of protrusions extending from said first surface and a plurality of protrusions extending from said second surface.

* * * * *